US006386151B1

(12) United States Patent
Powell

(10) Patent No.: US 6,386,151 B1
(45) Date of Patent: May 14, 2002

(54) ALUMINUM THROTTLE BODY CARTRIDGE WITH ENGINE CONTROL MODULE HEAT SINK

(75) Inventor: Jeff Powell, Belle River (CA)

(73) Assignee: Siemens Canada Limited, Tilbury (CA)

( * ) Notice: Subject to any disclaimer, the term of this patent is extended or adjusted under 35 U.S.C. 154(b) by 0 days.

(21) Appl. No.: 09/696,549

(22) Filed: Oct. 25, 2000

Related U.S. Application Data

(60) Provisional application No. 60/162,836, filed on Nov. 1, 1999.

(51) Int. Cl.[7] ..... F01P 1/06
(52) U.S. Cl. ..... 123/41.31; 361/690
(58) Field of Search ..... 123/41.31; 361/690, 361/694

(56) References Cited

U.S. PATENT DOCUMENTS 4,050,093 A * 9/1977 Crall et al. ..... 361/692
4,766,869 A * 8/1988 de Concini et al. ..... 123/478
5,094,212 A * 3/1992 Kawaguchi et al. ..... 123/41.31
5,988,119 A * 11/1999 Trubllowski et al. .... 123/41.31

* cited by examiner

*Primary Examiner*—Noah P. Kamen

(57) ABSTRACT

The air supply system of the vehicle engine includes a flow body that allows for the flow of air through a flow passage to the vehicle engine. An aluminum support mounts the engine control module. This support is then placed in communication with cool air flowing through the flow passage. Heat is accordingly dissipated from the engine control module. Because of the proximity of the air supply system to the vehicle engine, the wire harness for the engine control module is shortened.

12 Claims, 2 Drawing Sheets

ALUMINUM THROTTLE BODY CARTRIDGE WITH ENGINE CONTROL MODULE HEAT SINK

This application claims priority to Provisional Patent Application Ser. No. 60/162,836, filed Nov. 1, 1999.

BACKGROUND OF THE INVENTION

This invention relates to an air supply system that serves to dissipate heat from an engine control module for a vehicle.

An air supply system provides clean air to engine cylinders of a vehicle. Such a system includes an intake opening that allows air to flow through a flow passage into a manifold, which then distributes air to the engine cylinders. Typically, a throttle valve controls the flow of air in the flow passage through the opening and closing of a throttle blade.

An engine control module controls the operation of the engine, including fuel injection, air fuel mixture, emissions, and other functions of the vehicle engine. Electronic components on the engine control module are susceptible to overheating. Accordingly, an engine control module is frequently mounted away from the heat of the vehicle engine. The location of the engine control module away from the engine, however, results in a long wire harness.

A need therefore exists to dissipate heat from the engine control module in closer proximity to the vehicle engine.

SUMMARY OF THE INVENTION

In a disclosed embodiment of this invention, the air supply system of the vehicle engine includes a flow body that allows for the flow of air through a flow passage to the vehicle engine. An aluminum support mounts the engine control module. This support is then placed in communication with cool air flowing through the flow passage. Heat is accordingly dissipated from the engine control modulo. Because of the proximity of the air supply system to the vehicle engine, the wire harness for the engine control module is consequently shortened.

Another embodiment of the invention mounts the engine control module onto a support inserted into the flow passage. This support mounts the throttle valve, which is in communication with air in the flow passage. Accordingly, the invention takes advantage of existing heat conductive components of the air supply system to dissipate heat from the engine control module. These throttle components include bearings, seals, and a throttle position sensor.

These and other features of the present invention can be best understood from the following specification and drawings, the following of which is a brief description.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
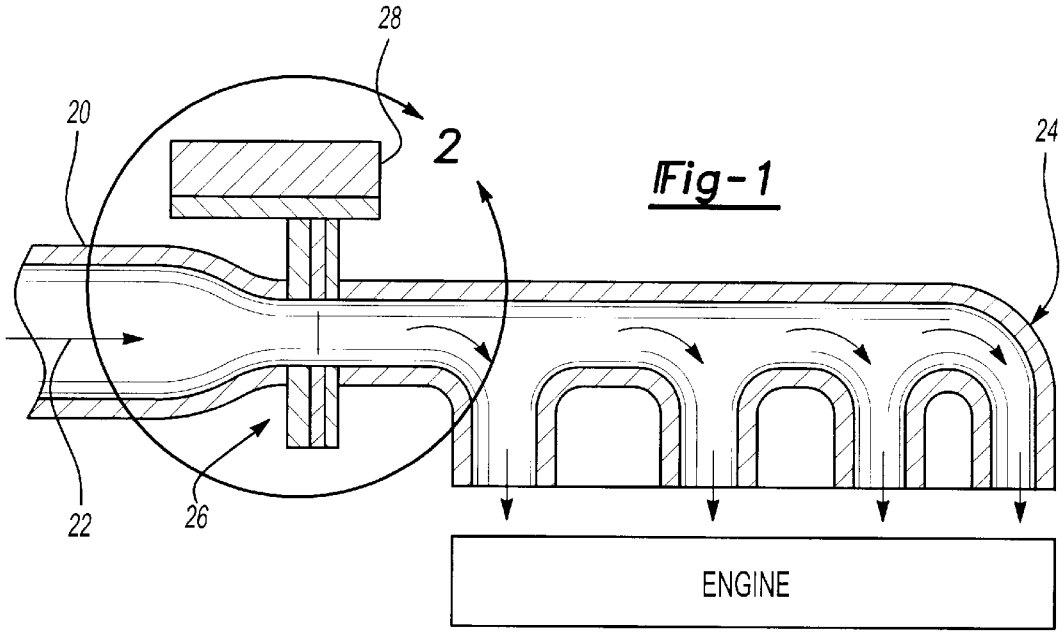
FIG. 1 shows the present invention in its environment, an engine control module in communication with a flow body, including flow passage, and manifold.

FIG. 1 presents a view of the present invention in its environment. Flow body 20, including flow passage 22, and engine manifold 24 are presented. Support 26 communicates with air flowing through flow passage 22. Engine control module 28 is mounted to support 26, allowing heat from engine control module 28 to dissipate to the air. Engine control module 28 controls the operation of a vehicle engine, including fuel injection, air fuel mixture, emissions, and other functions.

Figure 2:
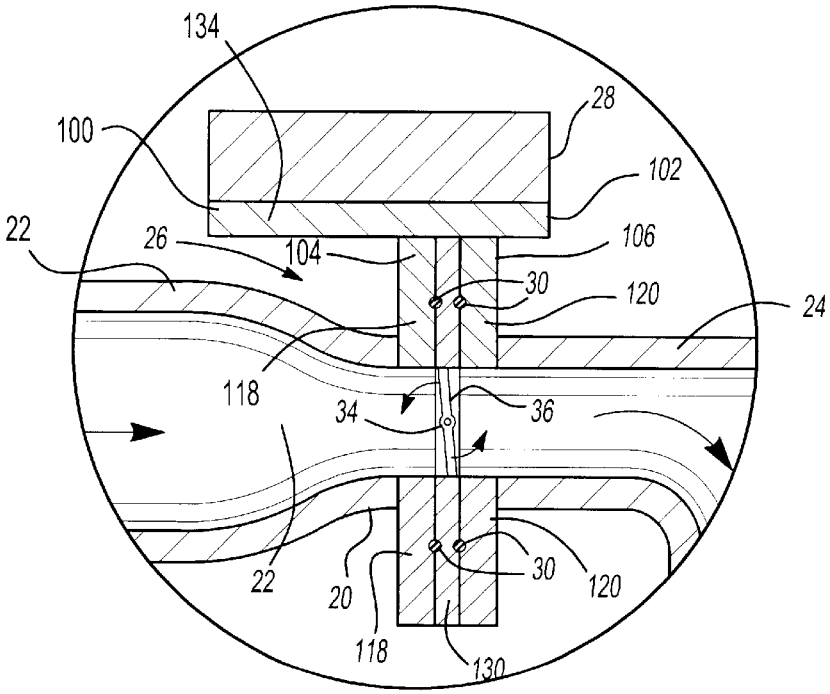
FIG. 2 shows a magnified view of the invention of FIG. 1, including electronic control module and support.

FIG. 2 presents a magnified view of the invention of FIG. 1. Flow body 20 and flow passage 22 interconnect with support 26, which mounts engine control module 28. In this view, seal 30, throttle shaft 34, and throttle blade 36 are shown. Seal 30 prevents the communication of air to flow passage 22 from the interconnection of support 26 to flow body 20 and flow passage 22. Throttle shaft 34 and throttle blade 36 regulate the flow of air through flow passage and consequently to manifold 24 by rotating to an open or closed position.

Figure 3:
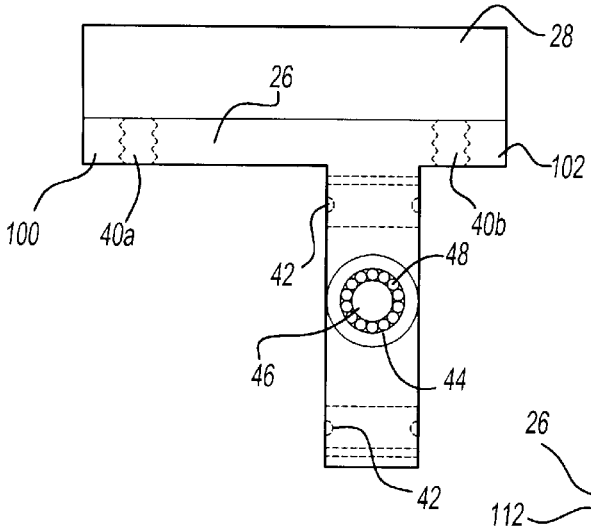
FIG. 3 shows a detailed view of an embodiment of the invention, including electronic control module, support, throttle blade, throttle shaft, bearing bore, and seal.

FIG. 3 presents a detailed view of an embodiment of the invention. Support 26 is shown with engine control module 28. Engine control module 28 is mounted to support by fasteners placed in holes 40A and 40B. Seal grooves 42 are disposed in support 26 to allow flow body 20 to be sealed against support 26. In addition, bear bore 44 and shaft bore 46 permit the mounting of throttle shaft 34 and bearings 48.

Figure 4:
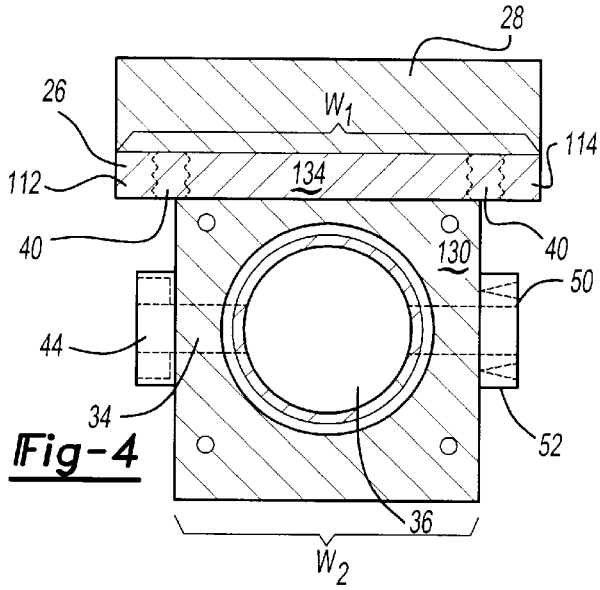
FIG. 4 shows a cross-sectional view of FIG. 3, including throttle blade and throttle shaft.

A cross-sectional view of the embodiment of FIG. 3 is shown by FIG. 4. Support 26, engine control module 28, throttle shaft 34, throttle blade 36, bearing bore 44 and now bearing bore 50 are illustrated. In addition, the invention provides a mount 52 for throttle position sensor 60, shown in FIG. 5.

Referring back to FIG. 2, support 26 comprises first planar member 134 and second planar member 130 that extends generally perpendicularly from first planar member 134. First planar member 134 supports engine control module 28 and comprises first portion 100 and second portion 102, first 100 portion extending on one side of second planar member 130 and second portion 102 extending on the other side (see FIGS. 2 and 3). Sandwiching second planar member 130 are first lip 118 and second lip 120. First lip 118 extends circumferentially around first portion 22 of flow body 20 while second lip 120 extends circumferentially around second portion 24 of flow body 24 as shown. First lip 118 is generally perpendicular to first portion 22 while second lip 120 is also generally perpendicular to second portion 24. Seals 30 are spaced between first lip 118 and second planar member 130 and between second lip 120 and second planar member 130. As shown in FIG. 4, first planar member 134 has a cross-sectional width W1 relative to the flow path of air greater than the cross-sectional width W2 of second planer member 130.

Figure 5:
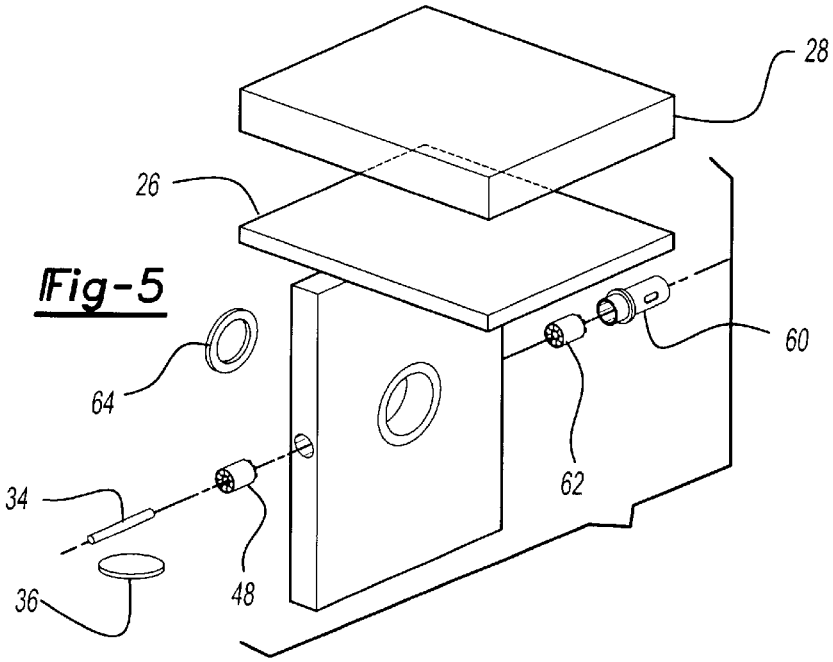
FIG. 5 shows an exploded view of the invention FIG. 4, including a throttle position sensor.

FIG. 5 shows an exploded view of an embodiment of the invention, including throttle position sensor 60. Support 26, engine control module 28, throttle shaft 34, bearings 48 and 62, and throttle blade 36 are shown disassembled. Also, seal

64 serves to prevent leaking of air through bearing 48. Throttle position sensor 60 is shown in relation to support 26. Throttle position sensor 60 may also be integrated with engine control module 28. Other components of the air supply system may also be integrated to support 26.

The aforementioned description is exemplary rather then limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. An air supply system for a vehicle engine comprising:

a flow body including a flow passage defined along an axially direction within two spaced portions, a first of said portion having a first lip extending radially outwardly from a nominal diversion of said first portion and a second lip extending radially outwardly from a nominal diversion of a second of said portions;

an engine control module; and a support supporting said engine control module and between said first lip and said second lip, conducting heat from said engine control module to air in said flow passage.

2. A system as set forth in claim 1, wherein said support is an insert.

3. A system as set forth in claim 1, wherein said support includes a seal between at least one of said lips and said support to prevent the communication of air to said flow passage.

4. A system as set forth in claim 1, wherein said support interconnects to a throttle valve.

5. A system as set forth in claim 4, wherein said throttle valve includes a throttle blade and throttle shaft.

6. A system as set forth in claim 5, wherein said throttle shaft interconnects to a bearing.

7. A system as set forth in claim 6, wherein said bearing interconnects to said support.

8. A system as set forth in claim 1, wherein said support is metal.

9. A system as set forth in claim 1, wherein said support is aluminum.

10. A system as set forth in claim 1 wherein said support comprises a first planar member and a second planar member extending generally perpendicularly from said first planar member wherein said first planar member supports said engine control module and said second planar member extends between said first lip and said second lip.

11. A system as set forth in claim 10 wherein said first planar member has a width perpendicular to the flow path of air greater than the width of said second planar member.

12. A system as set forth in claim 11, when said first planar member extends beyond said second planer member in both directions along said flow path.

* * * * *